United States Patent [19]

Shindo et al.

[11] Patent Number: 4,871,400

[45] Date of Patent: Oct. 3, 1989

[54] METHOD FOR PRODUCING TITANIUM STRIP HAVING SMALL PROOF STRENGTH ANISOTROPY AND IMPROVED DUCTILITY

[75] Inventors: Takuji Shindo; Hiromitsu Naito; Makoto Takeuchi, all of Kawasaki, Japan

[73] Assignee: Nippon Steel Corporation, Tokyo, Japan

[21] Appl. No.: 186,159

[22] Filed: Apr. 26, 1988

[30] Foreign Application Priority Data

Apr. 28, 1987 [JP] Japan ..... 62-103230

[51] Int. Cl.[4] ..... C22F 1/18

[52] U.S. Cl. ..... 148/12.7 B; 148/11.5 F; 148/133; 420/417; 420/421

[58] Field of Search ..... 148/11.5 F, 12.7 B, 148/133, 421; 420/417

[56] References Cited

U.S. PATENT DOCUMENTS 2,819,194 1/1958 Herres et al. ..... 148/12.7 B
3,492,172 1/1970 Sawvageot et al. ..... 148/11.5
3,963,525 6/1976 Bomberger, Jr. et al. ..... 148/421

FOREIGN PATENT DOCUMENTS 2158855 7/1987 Japan ..... 148/133

OTHER PUBLICATIONS

F. R. Larson, Twinning and Texture Transitions in Titanium Solid-Solution Alloys/P1169-1185 Titanium Science and Technology, vol. 2, Plenum Press, New York (1973).

*Primary Examiner*—Upendra Roy
*Attorney, Agent, or Firm*—Cushman, Darby & Cushman

[57] ABSTRACT

A method for producing a titanium strip having a small proof strength anisotropy and an improved ductility comprises the steps of: reheating a hot rolled titanium strip containing 0.1% by weight or less of oxygen and 0.1 to 0.5% by weight of iron at a $\beta$ region temperature and cooling by water, aging the obtained titanium strip at a temperature of 200° to 500° C. for 30 minutes or more, cold rolling the titanium strip at a rolling reduction of 30% or more; and, annealing the cold rolled titanium strip at a temperature of 600° to 800° C.

15 Claims, 3 Drawing Sheets

COLD ROLLING REDUCTION 67% → ANNEALING (650°C x 5hr)

•: ROLLING DIRECTION

△: 45° DIRECTION FROM ROLLING DIRECTION

○: 90° DIRECTION FROM ROLLING DIRECTION

METHOD FOR PRODUCING TITANIUM STRIP HAVING SMALL PROOF STRENGTH ANISOTROPY AND IMPROVED DUCTILITY

BACKGROUND OF THE INVENTION

1. Field of the Invention

The present invention relates to a method for producing a titanium strip having a small proof strength anisotropy and improved ductility, by a strip rolling method.

The term "proof strength anisotropy" denotes the ratio of a proof strength in a rolling direction (L direction) to that in a direction (T direction) perpendicular to the L direction.

2. Description of the Related Art

The production of pure titanium is usually carried out by the steps of hot rolling, annealing, pickling, cold rolling, and final annealing.

However, the usual hot rolled strips or sheets and cold rolled and annealed strips or sheets contain a remarkable proof strength anisotropy. Namely, an L direction value $\sigma_y L$ of a yield strength or a 0.2% proof strength (if a yield is not generated) is smallest and a T direction value is largest, whereby the proof strength anisotropy, i.e., the ratio $\sigma_y T/\sigma_y L$, is about 1.3. Therefore, the rolled pure titanium has an overhang, and this leads to shape defects during fabrication, such as deep drawing, remarkable earing generation or a press cracking.

To solve these problems, the conventional methods of cross rolling and slight rolling process after annealing, etc., are widely used.

However, the cross rolling process can not be used for unidirectional rolling process, such as for the strip rolling.

Further, in the slight rolling process, the effects which solve the above-mentioned problem are lost by a full annealing.

Japanese Unexamined Patent Publication (Kokai) No. 60-194052 discloses a method for producing an titanium strip wherein a titanium hot rolled strip having an oxygen content of 0.25% by weight and an Fe content of 0.20% by weight is cold rolled by an undirectional rolling, and annealed and this cold rolling and annealing are repeated, whereby the proof strength anisotropy of the obtained titanium strip can be kept lower than 1.15.

Namely, in the above process, the proof strength anisotropy $\sigma_{0.2}(T)/\sigma_{0.2}(L)$ is within 1.07 to 1.15.

However, the properties of the strength and the ductility of the obtained titanium strip are the same as a high strength and a low ductility type strip and thus can be used as a high strength member, but cannot be used as a fabrication material due to the poor ductility thereof.

SUMMARY OF THE INVENTION

An object of the present invention is to provide a method for producing a titanium strip or sheet having a small proof strength anisotropy and an improved ductility which can be used in an unidirectional rolling process.

According to the present invention there is provided a method for producing a titanium strip having a small proof strength anisotropy and an improved ductility, comprising the steps of:

reheating a hot rolled titanium strip containing 0.1% by weight or less of oxygen and 0.1 to 0.5% by weight of iron at a $\beta$ region temperature and cooling by water;

aging the obtained titanium strip at a temperature of 200° to 500° C. for 30 minutes or more;

cold rolling the titanium sheet at a rolling reduction of 30% or more; and, annealing the cold rolled titanium strip at a temperature of 600° to 800° C.

According to the present invention there is further provided another method for producing a titanium strip having a small proof strength anisotropy and an improved ductility, comprising the steps of:

reheating a hot rolled titanium strip containing 0.1% by weight or less of oxygen and 0.1 to 0.8% by weight %, in total, of copper and/or silicon and cooling by water, aging the obtained titanium strip at a temperature of 300° to 600° C. for 30 minutes or more, cold rolling the obtained titanium strip at a rolling reduction of 30% or more; and, annealing the cold rolled titanium strip at a temperature of 600° to 800° C.

DESCRIPTION OF THE PREFERRED EMBODIMENTS

Figure 1:
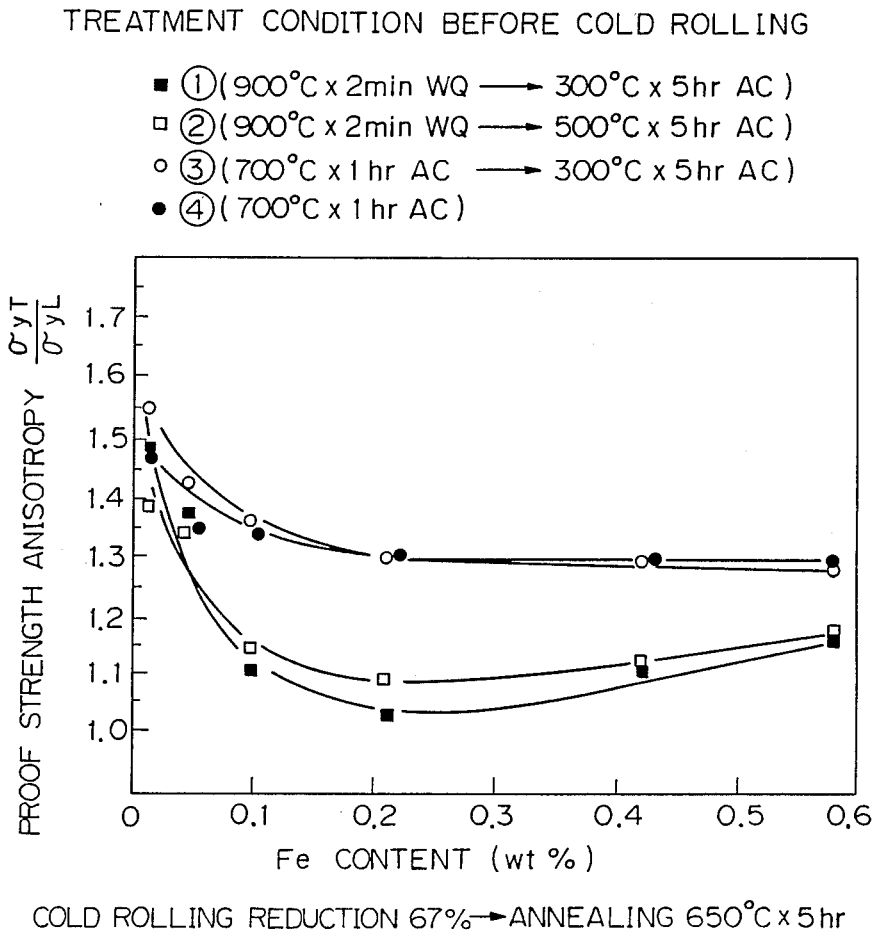
FIG. 1 illustrates a relationship between the Fe content and the proof strength anisotropy in a Ti-Fe series strip in four treatment conditions before cold rolling.

The preferred embodiments of the present invention will now be described with reference to the accompanying drawings.

The present inventor investigated the rolling texture formation mechanism of an $\alpha$-titanium in unidirectional rolling in detail by a computer simulation process and found that, (1) a split-TD texture component reresented as $(0001)\pm 35\sim 45°$ TD which is originally related to hexagonal crystal structure of $\alpha$-titanium is formed by a combination of slip type deformation modes and twin type deformation modes, especially affected in case of the twin type deformation modes, (2) when a deformation is carried out by a slip deformation modes such as a type ones: $\{hkil\}\langle 11\bar{2}0\rangle$, an ideal Basal texture orientation is formed, (3) Thus, it is important to prevent the generation of the twin deformation, to obtain a low proof strength titanium material.

The present inventor then attempted to prevent the occurrence of the twin deformation by making finely and dispersedly distributed precipitates in an $\alpha$-titanium matrix without increasing an amount of an interstitial element such as oxygen, which remarkably lowers the ductility and found that when an amount of about solubility limit in a $\alpha$ phase of Fe, Cu or Si which makes a $\beta$-eutectoid binary alloy with titanium is added to titanium and a suitable heat treatment is carried out an $\alpha$-dispersive type fine precipitates such as TiFe, $Ti_2Cu$ and $Ti_5Si_3$, etc. are dispersedly precipitated, and that when the obtained titanium strip is cold rolled a cross slip during the rolling is promoted by the precipitates and the occurrence of twin, can be prevented.

Therefore, the present inventor found that the development of split-TD texture is decreased and Basal texture orientation is relatively increased so that the anisotropy in the strip remarkably becomes small.

When a $\beta$-eutectoid type alloy element is added to $\alpha$-Ti at an amount of above solubility limit, a spherodized $\beta$ phase or compound is formed at a grain boundary, since a local formation of condensed segregation is apt to occur.

For example, in the Ti-Fe series, the solubility limit of the $\alpha$ phase Fe at 600° C., which is just above the $\beta$-eutectoid temperature, is about 0.06% by weight. Thus, when an $\alpha$ region treatment (750° C. for about 2 minutes), which is usually carried out as an annealing treatment for a hot rolled strip before cold rolling, is carried out, the Fe condensation occurs at the grain boundary portion and a uniform distribution of fine Ti-Fe precipitates is not easily carried out within $\alpha$-Ti matrix. Therefore, in the present invention, the $\alpha$ region treatment is not carried out as an annealing treatment before cold rolling. Further, in view of crystal orientation, the $\alpha$ region treatment forms a split-TD texture, and the main orientation component is enhanced by a cold rolling so that the anisotropy of a finally annealed strip is increased, which is not compatible with the object of the present invention.

According to the present invention, by carrying out an aging treatment at a temperature ranging from 200° to 500° C., the crystal orientation is given a random orientation due to the transformation from $\beta$-phase to $\alpha$-phase, and at the same time, a Ti-Fe compound is precipitated finely and dispersedly in an $\alpha$ titanium crystal grain, whereby a twin generation during cold rolling is prevented and the proof anisotropy $\sigma_y T/\sigma_y L$ is lower than 1.15. In this case, in the present invention, to prevent a decrease in ductility, the oxygen content is controlled to below 0.1% by weight, preferably, below 0.08% by weight. However, when the oxygen content falls below 0.03% by weight, the proof strength anisotropy tends to increase, and thus the most preferable oxygen content is from 0.03 to 0.08% by weight.

The Fe content is from 0.1 to 0.5% by weight. If the iron content is less than 0.1% by weight the effect is small, but if the iron content is above 0.5% by weight the effect is decreased and there is an unnecessary increase of strength and the ductility is decreased. According to experiments, preferably the iron content is from 0.2 to 0.3% by weight.

Although, in the present invention, the $\beta$ region treatment temperature and the holding time are not controlled, a temperature region of from $\beta$ transus temperature to 950° C. for about 1 to 10 minutes is preferable from the point of view of preventing grain growth and oxydization.

Cooling after the $\beta$ region treatment is preferably carried out by water cooling or a rapid cooling such as water cooling, whereby iron forming a solid solution in a $\beta$ phase can be frozen in the state of a solid solution. When the cooling is carried out by air cooling or a cooling having a lower cooling rate, the iron concentration in the $\alpha$ phase is decreased and thus the iron concentration is remarkably increased at a boundary between the $\alpha$ phase in a lamellar structure casued by the $\beta$ to $\alpha$ phase transformation, whereby the effect subsequent to the low temperature aging treatment is decreased.

In the aging treatment, a holding temperature of less than 200° C. causes an insufficient diffusion of the iron, with the result that the precipitation of fine Ti-Fe compound is reduced. On the other hand, a holding temperature of more than 500° C. causes an excessive promotion of the iron diffusion, so that the iron is condensed at a grain boundary portion and thus embrittlement develops thereat and the fine precipitation is remarkably decreased in a grain. To obtain the fine precipitates in the grain, an aging treatment at a temperature of about 300° C. is preferable.

An aging treatment time of less than 30 minutes provides no improvement of the effects, and an aging treatment hour of for five hours is preferable.

The cold rolling is carried out in the longitudinal direction of a hot rolled sheet, and in the first cold rolling process, a 30% or more reduction is applied to the strip. If a reduction of less than 30% is applied thereto, a Basal texture component is not sufficiently increased. The upper limit of the reduction is not restricted, but preferably is in the range of from 40 to 70%. In the present invention, the final annealing after the cold rolling is carried out at a temperature ranging from 600° C. to 800° C. In the final annealing, a temperature of less than 600° C. lowers the recrystallization rate and fine grains occur so that the ductility is disadvantageously decreased.

On the other hand, a final annealing temperature of more than 800° C. is unsuitable, since the proof strength anisotropy is thus excessively increased or excessive grain growth occurs. From the viewpoint of ductility and crystal grain size, preferably the final annealing temperature is in a range of from 650° to 700° C.

The above described process is applied not only to a Ti-Fe series but also to a Ti-Cu series, Ti-Si series, and Ti-Cu-Si series, since they are $\beta$-eutectoid type and an $\alpha$-dispersive type series in which fine precipitates in an $\alpha$ phase is distributed by an aging treatment.

The Ti-Cu series has a $\gamma$-eutectoid temperature of about 790° C., which is higher by 200° C. than that of the Ti-Fe series. In the Ti-Cu series, a maximum amount of the solid solution of Cu in the $\alpha$ phase is about 2.1% by weight, which is relatively high. Further, a uniform distribution of fine $Ti_2Cu$ precipitates is generated in an $\alpha$ phase grain by an aging treatment at about 400° C.

In a Ti-Si series, the $\beta$-eutectoid temperature is about 860° C. and the maximum limit of solubility is 0.65% by weight. During the cooling and aging treatment, $Ti_5Si_3$ is precipitated in the $\alpha$ phase.

In the Ti-Cu-Si series, both $Ti_2Cu$ and $Ti_5Si_3$ are precipitated together, and thus, since the Ti-Cu-Si series has the same effects as in the above-explained Ti-Fe series, it is suitable for a composition series having a low proof strength anisotropy.

In the composition of the Ti-Cu series whereby only an addition of copper is made, the composition of copper preferably ranges from 0.1 to 0.8% by weight. If less than 0.1% by weight, $Ti_2Cu$ is not precipitated and the effect of controlling the anisotropy can not be obtained, and if above 0.8% by weight, the anisotropy effect is decreased, an unnecessary strength is obtained and the ductility is lowered.

When only an addition of silicon is made, the composition of silicon also preferably ranges from 0.1 to 0.8, and in the case of a composite addition of Cu and Si, the total composition thereof ranges from 0.1 to 0.8% by weight. The aging of the Ti-Cu series and the Ti-Cu-Si series is carried out at a temperature ranging from 300° to 600° C., and this temperature is maintained for 30 minutes or more.

At a temperature of less than 300° C., a sufficient amount of precipitates can not be obtained, and if higher than 600° C., whereat over-aging occurs, the precipitates become coarse and the anisotropy effect is lost. The desirable aging temperature is about 400° C. in the Ti-Cu series, and about 550° C. in the Ti-Si series. In the case of the Ti-Cu-Si series the desirable aging temperature is an aging temperature suitable for the main element thereof. The cold rolling and the final annealing conditions are restricted in the same way as for the Ti-Fe series.

When a total amount of 0.05 to 0.3% by weight of at least one of an element consisting of B (boron) and rare earth metal of Y, La, and Ce is added to the titanium material of the Ti-Fe, Ti-Si or Ti-Cu-Si series material, fine boronide and oxide particles are formed so that an anisotropy effect similar to that obtained in the above-explained Ti-Fe or Ti-Cu series strip can be obtained. Further, the addition of B and such a rare earth metal prevents a coarsening of $\beta$ grains when the strip is heated in the $\beta$ region for short time, whereby the occurrence of twin deformation during the cold rolling is prevented. If less than 0.05% by weight, the anisotropy effect is decreased, and if above 0.3% by weight, the ductility of the material is lost.

EXAMPLE 1

The following four heat treatment processes were carried out on a 3 mm thick titanium hot rolled strip having the chemical compositions A-1 to A-6 as shown in Table 1.

(1) $\beta$ region heat treatment at 900° C. for 2 minutes→Water quenching (WQ)→Aging at 300° C. for 5 hours.

(2) $\beta$ region heat treatment at 900° C. for 2 minutes→WQ→Aging at 500° C. for 5 hours.

(3) $\alpha$ region heat treatment at 700° C. for 1 hour→Air cooling→Aging at 300° C. for 5 hours.

(4) $\alpha$ region heat treatment at 700° C. for 1 hour→Air cooling.

After the four treatments were carried out, respectively, cold rolling at a reduction of 67% was carried out one time in a hot rolled direction so that a 1 mm thick strip was produced.

With regard to treatment (1) tests at a cold rolling reduction of 20%, 30%, 40%, and 50% were also carried out, respectively. After the cold rolling, annealing at 650° C. for 5 hours was carried out as a final annealing and the mechanical properties and the anisotropy $\sigma_y T/\sigma_y L$ of the annealed strips were tested by using the applicable ASTM standard.

TABLE 1

| Sample | Chemical composition (wt %) O | C | N | H | Fe | Ti | Remarks |
|---|---|---|---|---|---|---|---|
| A-1 | 0.048 | 0.008 | 0.004 | 0.0022 | 0.012 | remainder | invention |
| A-2 | 0.047 | 0.007 | 0.006 | 0.0023 | 0.044 | " | " |
| A-3 | 0.053 | 0.008 | 0.007 | 0.0025 | 0.094 | " | " |
| A-4 | 0.046 | 0.008 | 0.006 | 0.0019 | 0.208 | " | " |
| A-5 | 0.054 | 0.005 | 0.006 | 0.0021 | 0.42 | " | " |
| A-6 | 0.045 | 0.007 | 0.005 | 0.0020 | 0.58 | " | comparative example |

Figure 2:
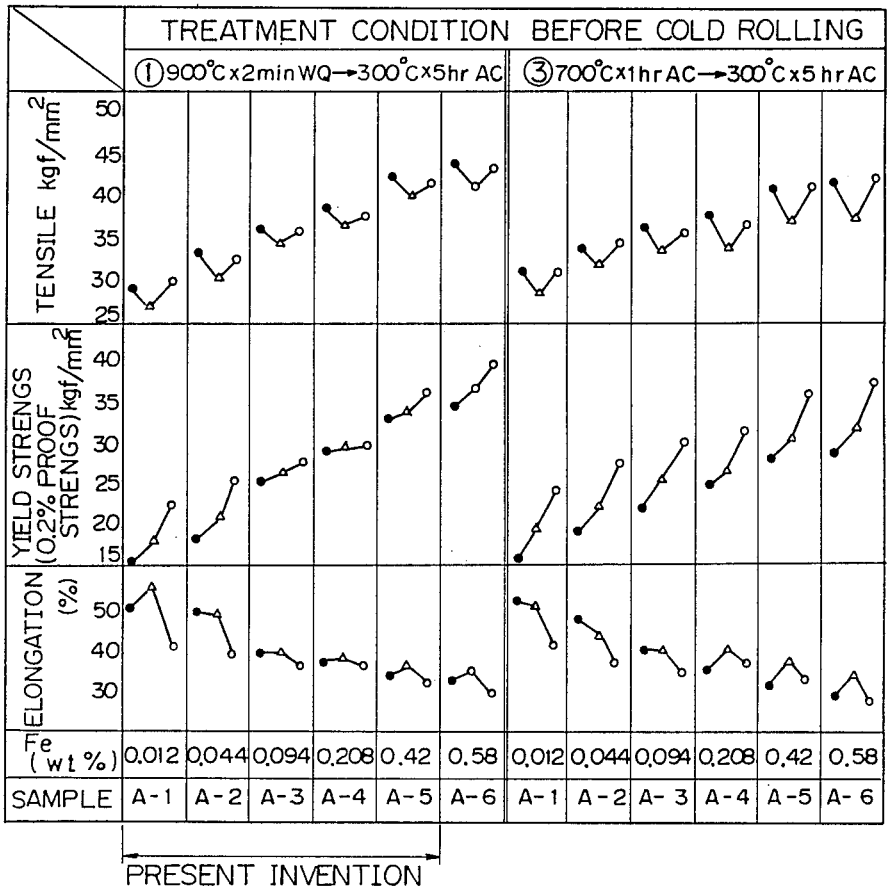
FIG. 2 illustrates a relationship between the Fe content and the mechanical properties in the Ti-Fe series strip in two treatment conditions before cold rolling; and, FIG. 3 illustrates a relationship between the (Cu or Si content) and the anisotropy in Ti-Cu, Ti-Si and Ti-Cu-Si series strips.

FIG. 1 illustrates examples of the proof strength anisotropy in the case of a rolling reduction of 67%, and FIG. 2 illustrates examples of the mechanical properties of (1) and (3) when cold rolled at a rolling reduction of 67%.

As shown in FIG. 1, when the $\alpha$ region heat treatments (3) and (4) are carried out as a treatment before cold rolling, the anisotropy is decreased by the amount of Fe, but the obtained anisotropy is 1.3, which shows that the effect is small.

On the other hand, when $\beta$ region heat treatments (1) and (2) are carried out, the anisotropy is rapidly decreased with the addition of Fe. Namely, when an aging is carried out at 300° C., the anisotropy $\sigma_y T/\sigma_y L \leqq 1.15$ in Fe range of from 0.1 to 0.5% by weight particularly at 0.2% by weight of Fe, the anisotropy is minimized, and thus a remarkable effect is obtained.

When cold rolling is carried out by a rolling reduction of 30% or more the anisotropy become substantially the same value in FIG. 1.

EXAMPLE 2

Using a 3 mm thick titanium hot rolled strips having the Ti-Cu, Ti-Si, and Ti-Cu-Si series compositions shown in Table 2 by B-1 to D-1, a $\beta$ region heat treatment was carried out at 900° C. for 2 minutes, followed by water quenching. Subsequently, in the Ti-Cu series and the Ti-Cu-Si series, aging at 400° C. was carried out for 10 hours, and in the Ti-Si series, aging at 550° C. was carried out for 4 hours. Then, a cold rolling at a reduction of 67% was carried out one time in the hot rolled direction, and thus a 1 mm thick sheet was produced.

After the cold rolling an vacuum annealing at 650° C. for 5 hours was carried out and the mechanical properties were tested.

TABLE 2

| Sample | Chemical composition (wt %) O | C | N | H | Fe | Cu | Si | Ti | Treatment condition before cold rolling | Cold rolling reduction | Final annealing | $\sigma_y T/\sigma_y L$ | Remarks |
|---|---|---|---|---|---|---|---|---|---|---|---|---|---|
| B-1 | 0.046 | 0.006 | 0.004 | 0.0023 | 0.032 | 0.21 | — | remainder | 900° C. × 2 min→WQ →400° C. × 10 Hr→AC | 67% | 650° C. × 5 Hr | 1.11 | Invention (Ti—Cu series) |
| B-2 | 0.043 | 0.006 | 0.007 | 0.0031 | 0.035 | 0.48 | — | above | " | " | " | 1.08 | " |
| B-3 | 0.045 | 0.007 | 0.005 | 0.0027 | 0.041 | 0.90 | — | above | " | " | " | 1.18 | Comparative Example (Ti—Cu series) |
| C-1 | 0.050 | 0.005 | 0.006 | 0.0025 | 0.040 | — | 0.11 | above | 900° C. × 2 min→WQ | " | " | 1.15 | Invention (Ti—Si series) |
| C-2 | 0.051 | 0.006 | 0.007 | 0.0020 | 0.036 | — | 0.32 | above | →550° C. × 4 Hr→AC | " | " | 1.09 | " |
| C-3 | 0.049 | 0.005 | 0.006 | 0.0023 | 0.038 | — | 0.51 | above | " | " | " | 1.10 | " |
| D-1 | 0.045 | 0.007 | 0.006 | 0.0027 | 0.030 | 0.49 | 0.10 | above | 900° C. × 2 min→WQ | " | " | 1.04 | Invention |

TABLE 2-continued

| Sample | Chemical composition (wt %) O | C | N | H | Fe | Cu | Si | Ti | Treatment condition before cold rolling | Cold rolling reduction | Final annealing | $\sigma_yT/\sigma_yL$ | Remarks |
|---|---|---|---|---|---|---|---|---|---|---|---|---|---|
| | | | | | | | | | →400° C. × 10 Hr→AC | | | | (Ti—Cu—Si series) |

Figure 3:
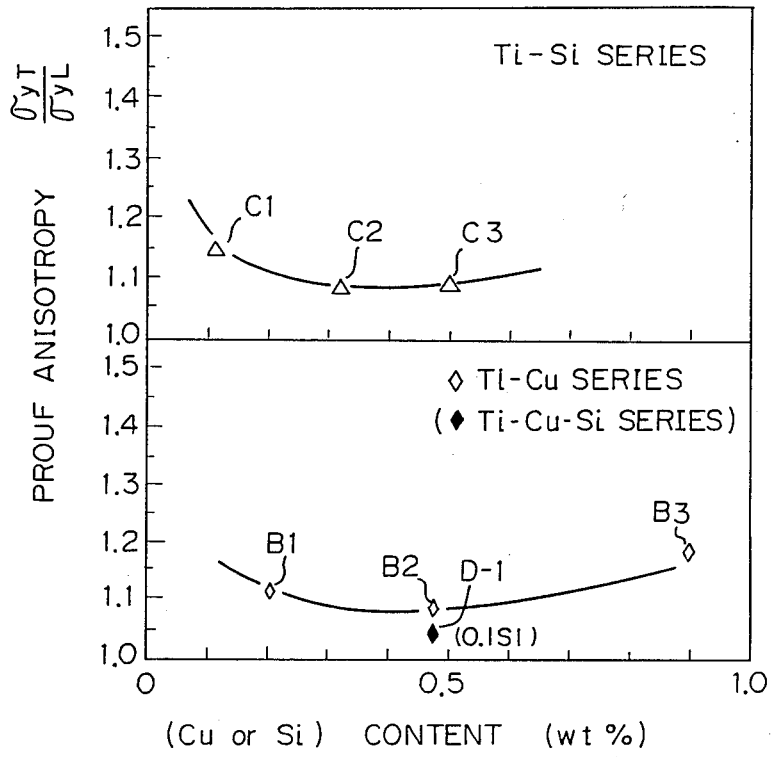

The obtained anisotropy $\sigma_yT/\sigma_yL$ is shown in FIG. 3.

In both the Ti-Cu series and Ti-Si series, in each composition of Cu and Si of 0.1 to 0.8% by weight an anisotropy of $\sigma_yT/\sigma_yL \leqq 1.15$ was obtained.

In the Ti-Cu series wherein the Cu was contained at 0.5% by weight, the anisotropy $\sigma_yT/\sigma_yL$ was minimized. When 0.1% by weight of Si was added to the Ti-Cu series, the anisotropy was further improved. Further, in the Ti-Si series having an Si content of about 0.3% by weight, the anisotropy was minimized.

In example 2, the elongation of each material was larger than 35% in the L direction.

EXAMPLE 3

Using 3 mm thick titanium hot rolled strips having the compositions A-7 to B-6 shown in Table 3, a heat treatment before cold rolling was carried out on each strip.

Then, a cold rolling at a reduction of 73% was carried out one time in the hot rolled direction, and thus a 0.8 mm thick strip was produced.

TABLE 3

| Sample | Chemical composition (wt %) O | C | N | H | Fe | Cu | Y | La | Ce | B | Ti | Treatment condition before cold rolling | Cold rolling reduction | Final annealing | $\sigma T/\sigma L$ | Remarks |
|---|---|---|---|---|---|---|---|---|---|---|---|---|---|---|---|---|
| A-7 | 0.045 | 0.006 | 0.005 | 0.0025 | 0.21 | — | 0.1 | — | — | — | remainder | 900° C. × 2 min → WQ → 300° C. × 5 Hr →AC | 73% | 650° C. × 5 Hr | 1.10 | Invention (Ti—Fe—Y series) |
| A-8 | 0.045 | 0.006 | 0.005 | 0.0025 | 0.21 | — | — | 0.2 | — | — | " | " | " | " | 1.09 | Invention (Ti—Fe—La series) |
| B-4 | 0.046 | 0.007 | 0.006 | 0.0030 | 0.032 | 0.48 | 0.1 | — | — | — | " | 900° C. × 2 min → WQ → 400° C. × 10 Hr → AC | " | " | 1.06 | Invention (Ti—Cu—Y series) |
| B-5 | 0.046 | 0.007 | 0.006 | 0.0030 | 0.032 | 0.48 | — | — | 0.1 | — | " | " | " | " | 1.05 | Invention (Ti—Cu—Ce series) |
| B-6 | 0.046 | 0.007 | 0.006 | 0.0030 | 0.032 | 0.48 | 0.1 | — | — | 0.1 | " | " | " | " | 1.04 | Invention (Ti—Cu—Y—B series) |

After the cold rolling, a vacuum annealing at 650° C. for 5 hours was carried out and the mechanical properties were tested.

The obtained anisotropy $\sigma_yT/\sigma_yL$ was about 1.10 in both the A-7 and A-8 strips and 1.05 in the B-4, B-5 and B-6 strips, which exhibited remarkable anisotropy effects.

In example 3, the elongation of each material was larger than 35% in the L direction.

We claim:

1. A method for producing a titanium strip having a small proof strength anisotropy and an improved ductility, comprising the steps of:

(a) reheating a hot-rolled titanium strip containing at most about 0.1% by weight of oxygen and 0.1 to 0.5% by weight of iron at a $\beta$ region temperature and cooling by water;

(b) aging the thus obtained titanium strip at a temperature of 200° C. to 500° C. for at least 30 minutes;

(c) cold rolling the thus obtained aged titanium strip at a rolling reduction of at least 30%;

(d) annealing the cold rolled titanium strip at a temperature of 600° C. to 800° C.

2. The method according to claim 1, wherein the hot rolled titanium strip further contains at least one element selected from the group consisting of boron, yttrium, and lanthanum in an amount in total of 0.05 to 0.3% by weight.

3. The method according to claim 1 or 2, wherein the content of oxygen ranges from 0.03 to 0.08% by weight.

4. The method according to claim 1 or 2, wherein the content of iron ranges from 0.2 to 0.3% by weight.

5. The method according to claim 1 or 2 wherein, reheating is carried out at a temperature ranging from $\beta$ transus to 950° C. for 1 to 10 minutes.

6. The method according to claim 1 or 2, wherein aging is carried out at a temperature of about 300° C. for about 5 hours.

7. The method according to claim 1 or 2, wherein the cold rolling is carried out at a rolling reduction of from 40 to 70%.

8. The method according to claim 1, wherein the annealing is carried out at a temperature of 650° to 700° C.

9. The method according to claim 1, wherein the titanium strip further contains 0.05 to 0.3% by weight of Ce.

10. A method for producing a titanium strip having a small proof strength anisotropy and an improved ductility, comprising the steps of:

(a) reheating a hot rolled titanium strip which contains at most 0.1% by weight of oxygen and 0.1 to 0.8% by weight of an element selected from the group consisting of (i) copper, (ii) silicon and (iii) copper and silicon, and cooling by water;

(b) aging the thus obtained titanium strip at a temperature of 300° C. to 600° C. for at least 30 minutes;

(c) cold rolling the thus obtained titanium strip at a rolling reduction of at least 30%; and (d) annealing the thus cold rolled titanium strip at a temperature of 600° C. to 800° C.

11. The method according the claim 10, wherein the hot rolled titanium strip further contains at least one element selected from the group consisting of boron, yttrium and lanthanum in an amount in total of 0.05 to 0.3% by weight.

12. The method according to claim 11, wherein the hot rolled titanium strip further contains 0.05 to 0.3% by weight of Ce.

13. A method according to claim 10 or 11, wherein, in a Ti-Cu series, the aging is carried out at a temperature of about 400° C.

14. A method according to claim 10 or 11, wherein, in a Ti-Si series, the aging is carried out at a temperature of about 550° C.

15. The method for producing a titanium strip having a small proof strength anisotropy and an improved ductility comprising the steps of:

(a) reheating a hot rolled titanium strip containing from 0.03 to 0.08% by weight of oxygen, 0.2 to 0.3% by weight of iron, 0.5 to 0.3% by weight, in total, of at least one element selected from the group consisting of boron, yttrium and lanthanum, and cooling by water;

(b) aging the thus obtained titanium strip at a temperature of 200° C. to 500° C. for at least 30 minutes;

(c) cold rolling the thus obtained titanium strip by rolling reduction ranging from 40% to 70%; and (d) annealing the thus cold rolled titanium strip at a temperature of 650° C. to 700° C.

* * * * *